US011230856B2

(12) United States Patent
Everett et al.

(10) Patent No.: US 11,230,856 B2
(45) Date of Patent: Jan. 25, 2022

(54) AWNING ASSEMBLY

(71) Applicant: RHINO RACK AUSTRALIA PTY LIMITED, New South Wales (AU)

(72) Inventors: Kayle Richard Everett, New South Wales (AU); William Davis, New South Wales (AU); John Adriaan Klinkenberg, New South Wales (AU)

(73) Assignee: Rhino Rack Australia Pty Limited, New South Whales (AU)

( * ) Notice: Subject to any disclaimer, the term of this patent is extended or adjusted under 35 U.S.C. 154(b) by 0 days.

(21) Appl. No.: 16/627,403

(22) PCT Filed: Jun. 29, 2018

(86) PCT No.: PCT/AU2018/050673

§ 371 (c)(1),
(2) Date: Dec. 30, 2019

(87) PCT Pub. No.: WO2019/000050

PCT Pub. Date: Jan. 3, 2019

(65) Prior Publication Data

US 2020/0141151 A1 May 7, 2020

(30) Foreign Application Priority Data

Jun. 30, 2017 (AU) ..... 2017902547

(51) Int. Cl.
*E04H 15/06* (2006.01)
*E04H 15/48* (2006.01)
*E04H 15/38* (2006.01)

(52) U.S. Cl.
CPC ..... *E04H 15/06* (2013.01); *E04H 15/48* (2013.01); *E04H 15/38* (2013.01)

(58) Field of Classification Search
CPC ..... E04H 15/06; E04H 15/38
See application file for complete search history.

(56) References Cited

U.S. PATENT DOCUMENTS 6,273,115 B1 8/2001 Guggisberg
6,729,076 B1 5/2004 Gale
(Continued)

FOREIGN PATENT DOCUMENTS

AU 2012100108 3/2012
WO WO1998/007937 2/1998
(Continued)

*Primary Examiner* — David R Dunn
*Assistant Examiner* — Danielle Jackson
(74) *Attorney, Agent, or Firm* — Skinner and Associates; Joel D. Skinner, Jr.

(57) ABSTRACT

An awning assembly for use with a vehicle. The awning comprising an elongate base attachable to the vehicle, the base having a first end and an opposing second end, a portion of the second end of the base being magnetic or responsive to magnetic force. Arms are attached at the first and/or second end of the base, being pivotable relative to the base between a stowed position and a deployed position. A portion of each arm being magnetic or responsive to magnetic force. A flexible sheet associated with the arms, which in the deployed positon with the arms extending away from the base so that the flexible sheet provides cover to an area beneath the arms. In the stowed position, the arms are located adjacent the base so that the magnetic portions of the base and the arms connect, thereby securing the arms to the base.

13 Claims, 10 Drawing Sheets

(56) References Cited

U.S. PATENT DOCUMENTS

| | | | | | |
|---|---|---|---|---|---|
| 7,690,860 | B1 * | 4/2010 | Utz | E01F 9/677 | 404/9 |
| D622,413 | S * | 8/2010 | Cropley | D25/56 | |
| D622,414 | S * | 8/2010 | Cropley | D25/56 | |
| D698,941 | S * | 2/2014 | Cropley | D25/56 | |
| D870,318 | S * | 12/2019 | Everett | D25/57 | |

FOREIGN PATENT DOCUMENTS

| | | |
|---|---|---|
| WO | WO2004/099528 | 11/2004 |
| WO | WO2017/032828 | 3/2017 |

* cited by examiner

AWNING ASSEMBLY

TECHNICAL FIELD

The present invention relates to an awning assembly for use with a vehicle.

BACKGROUND TO THE INVENTION

An awning can be used to provide shade and or shelter from the weather. An awning can be a fixed structure, but with the increase in vehicle use, it is sometimes convenient to have a mobile awning structure associated with a vehicle. When the vehicle stops and the passenger(s) wish to get out and stretch and rest, the awning can be expanded and supported from e.g. the roof of the vehicle thereby providing a covered area for much-needed respite.

Once the awning is no longer required, the collapse and removal of the awning cover is preferably easy and quick to undertake, so that the driver and possibly other passengers can get back on the road. Furthermore, once collapsed, the awning must be stowed such that it does not cause any obstruction for the driver or to other vehicles. Accordingly, there is a need for an awning assembly that is in some embodiments easy to use and that is easy and safe to store once used.

Once a vehicle is travelling more than about 80 km/h, aerodynamic resistance becomes a real force which can act to remove or deploy various external items not secured to the vehicle, from the vehicle. It can be of use to reduce that force on externally-mounted items such as awnings and their associated arms.

SUMMARY OF THE INVENTION

In accordance with an embodiment of the present invention, there is provided an awning assembly for use with a vehicle, the awning assembly comprising:

an elongate base attachable to the vehicle, the base having a first end and an opposing second end, a portion of the second end of the base being magnetic or responsive to magnetic force;

arms attached at the first and/or second end of the base, the arms pivotable relative to the base between a stowed position and a deployed position, a portion of each arm being magnetic or responsive to magnetic force, a flexible sheet associated with the arms, wherein in the deployed position, the arms extend away from the base so that the flexible sheet provides cover to an area beneath the arms; and wherein in the stowed position, the arms are located adjacent the base so that the magnetic portions of the base and the arms connect thereby securing the arms to the base.

Preferably, the arms are disposed substantially against the elongate base and parallel therewith when in the stowed position, and the arms splay outwardly from the first and/or second end when in a deployed position.

Preferably, the arms are arranged on a pivot so that each one is disposed incrementally along a vertical pivot axis.

Preferably, each arm includes a support leg pivotally connected thereto by a joint, and each support leg is disposed outboard of its respective arm relative to the base, when the arms in the stowed position.

Preferably, the magnetic portion of each arm comprises a magnet attached to each arm.

Preferably, the magnetic portion of the base comprises a magnet mounted in a recess in the base such that the magnetic portion of the base is flush with the surface of the base body.

When in the deployed position the vehicle awning may provide a convenient cover in the form of shade or shelter to an area adjacent to the vehicle. The cover can be to protect the area from the weather e.g. to provide shade from the sun, and or to provide protection from rain. When the awning is in the stowed position, the arms of the assembly may be conveniently held against the base of the assembly so that they do not unintentionally move away from the base thereby potentially causing an unnecessary obstruction and or a danger e.g. the awning is stowed so that it may not wholly or partially expand while the vehicle is in motion.

The vehicle can be of the type that allows for the attachment of the awning assembly to the vehicle body. The vehicle can be a car e.g. a 4WD car, a van, a truck, or a towable vehicle such as a caravan or camper trailer. A vehicle awning may be mounted from the side of a vehicle. In preferred embodiments, the awning assembly may be attached at an elevated position on the vehicle body. The elevated position may be adjacent the roof of the vehicle, and on a rack or other ladder arrangement. The awning assembly is advantageously mounted to the vehicle in such a way that it can be used by an operator standing on the ground next to the vehicle.

The awning assembly comprises an elongate base (sometimes referred to as "base"). The base can be of any length and width to accommodate the various parts of the awning assembly. The base has a longitudinal axis running in the long direction. The length of the base along the longitudinal axis can be approximately the length of the vehicle roof. Alternatively, the base may be shorter than the length of the roof. The base may be longer than the length of the vehicle roof and in which case the base will extend past an edge of the roof. If the awning is longer than the vehicle roof, it may require additional support to ensure that the base is supported and does not bend or present an obstruction.

The base may be made from any suitable material that is strong and can withstand being attached to and carried on a vehicle at high speeds. In one embodiment, the base is formed from a plastic material but in preferred embodiments it is an aluminium alloy. The base may be attached directly to the vehicle body. Alternatively, the base may be attached to a roof rack mounted on the roof of the vehicle. The mounting of the base may be by using a bracket arrangement. The bracket arrangement may be designed specifically for mounting the base to specific roof rack types.

The base has a first end and an opposing second end. A plurality of arms of the awning assembly are attached at the first end of the base. The arms may comprise long support struts that, in use, provide a support structure or frame for the awning. In one embodiment there are at least 2, 3, 4, 5 or 6 arms. There may be more than 6 arms, but too many arms will increase the weight of the awning assembly and possibly make it more complicated to use and store. In a preferred embodiment there are 4 arms.

The arms support a flexible sheet associated with the arms. The flexible sheet can be associated with the arms by attaching it to the arms using known techniques. In an embodiment, the sheet is attached by clips to the arms. In an embodiment, the arms slide into pockets formed in the flexible sheet. Once the arms are in an expanded position, the flexible sheet can provide the cover function of the awning assembly. Persons and objects may be able to stand or sit under the cover of the flexible sheet. The flexible sheet can be made from a known shade material such as shade cloth or a light weight polyester/polyurethane. The flexible sheet can be treated in order to provide additional protection, such as UV protection or waterproofing. In one embodiment, the flexible sheet has a waterproof rating of at least about 1,500 mm, 2,000 mm or 2200 mm.

Depending on the desired shape and or area of cover of the resulting awning, the arms can be of various lengths. In an embodiment, the arms are all the same length. Alternatively, at least some of the arms can have different lengths. The length of each arm can be fixed such that when in use it extends to a known distance. Alternatively at least some of the arms can be telescopic. In an embodiment, once in the expanded position, the awning itself can fan out around the vehicle at least 180, 200, 270 degrees.

The arms of the assembly are able to support their own weight and the weight of the flexible sheet cover. In order to provide additional structural integrity, at least some of the arms can be adapted to allow them to extend outwards, and then towards the floor for floor support. This may be achieved by providing an articulated arm which has a sheet support arm, generally horizontally-disposed, and an arm support portion which in a deployed position is vertically disposed, and in a stowed position is horizontally disposed. Alternatively, the arm support portion may be connectable at a remote end to the sheet support arm portions which support each arm and allow the arrangement to provide shelter under the sheet. The arms may be made of metal or plastic. The arms may be hollow tubes to reduce their weight. The arms can have any cross-section including circular. There may be one or more reinforcing fin inside the hollow tube of the arm. In an embodiment, the arms are made from rust-proof anodised aluminium which may make for a strong and durable frame.

The attachment of the arms to the base can allow at least some or all of the arms to pivot. The pivotability of each arm can be within one plane; alternatively the pivot of each arm can be via a ball type joint which allows multiple pivot planes and therefore multiple resulting orientations of that arm. When in the deployed position, the arms may allow various configurations of the awning, some in which some arms are disposed higher than other arms to accommodate tall structures under the awning. The pivot points of the arms relative to the base may allow the awning assembly to have a stowed position and an expanded position. In the stowed position, the arms are not in use. In the stowed position, the arms are folded to be adjacent to the base. The arms may be stowed so as to all lie next to one another in planes substantially parallel to the longitudinal axis of the base.

In one embodiment the distal arm pivot is a bolt or axle, extending parallel with the ground, perpendicular to the base when in the stowed position. In one embodiment the distal arm pivot includes a tie down point so as to increase security of the sheet when in the deployed position.

In one embodiment the arm support has a foot having one or more through apertures for tent pegs. In one embodiment the through apertures are crossed for increased security. In one embodiment the foot has a tie down point.

In one embodiment the arms are extensible. In one embodiment the arm supports are extensible by telescoping. In one embodiment the sheet support arms are extensible by telescoping. The sheet may bunch up to facilitate the telescoping.

The arms may be arranged in the stowed position such that they are disposed in a regular array so as to form a convenient and compact shape.

In one embodiment the arms may adopt a 4×2 array. In other embodiments the arms may adopt a 3×2 array. There may be other arrays, such as 5×2, 6×2, 4×3, 3×3, 2×2, and the like. In one embodiment each sheet support arm may be held against the base, while the arm supports may be disposed on the other side of a respective sheet support arm, connected thereto by a pivot.

In one embodiment the sheet support arms may include a catch for catching the arm support portions. In one embodiment the catch is mounted on the sheet support arm at an intermediate portion so that the arm support portions may be able to be retained against the sheet support arm even if the arm support portion is not in an extended position. In one embodiment the catch is a flexible clip having arms defining a bight for cooperating with the arm cross-section and receiving it therein. In use the arm support is swung up from the ground and in one movement slips into the bight and retained there, in a horizontal position, stowed against the sheet support arm.

A portion of the base spaced from the first end is magnetic or responsive to magnetic force. The second end of the base may be magnetic. The magnetic portion can comprise one or more magnets. The magnetic portion can comprise a metal that can generate a magnetic field in response to an applied magnet. The term magnet includes within its scope metals that can become magnetic or are responsive to magnetic force. The magnetic portion can be made up of more than one discrete magnetic areas. In an embodiment, the magnetic portion comprises a series of small magnets attached to the base. Each small magnet can be of any shape and can be arranged so as to magnetically attract a single respective arm when the arm is folded by the pivot point to the stowed position. In another embodiment, the magnetic portion comprises a magnetic plate or a magnetic rod attached to the base. A rod may be arranged with a long axis thereof arranged perpendicular or some other angle relative to the longitudinal axis of the base. The plate can be arranged so as to extend over an area of the second end of the base. In an embodiment, the rod or the plate are arranged in a correspondingly shaped recess in the base. The recess can be formed during manufacture of the base. When the arms are folded for storage, each arm then contacts with the magnetic plate or magnetic rod and is magnetically held thereagainst. An advantage of having the magnet in a recess in the base is that the surface of the recessed magnet can be flush with the surface of the base body. This means that the surface of the base body can be substantially flat and free from obstruction. The flat and obstruction free surface of the base can be aesthetically pleasing. Furthermore the flat and obstruction free surface has fewer functional parts such as clips and straps, which inevitably wear over time and may eventually malfunction.

Other magnetic portions are within the spirit and scope of the invention, for example, there could be a series of small magnets and magnetic rods in any formation provided over the base so long as there is some magnetic contact available with the arms once stowed. Furthermore, while only a portion of the second end of the base need be magnetic, the whole base including the first end could be magnetic.

In addition to the base part, at least a portion of each arm is magnetic. The magnetic portion of each arm can comprise one or more magnets. The magnetic portion can comprise a metal that can generate a magnetic field in response to an applied magnet. The term magnet includes within its scope metals that can become magnetic. The magnetic portion can be made up of more than one discrete magnetic area on the arm. In one embodiment, the metal forming the arm is itself the magnet. In another embodiment, there is a magnet attached to the arm. The magnet attached to the arm can be one or more small magnets on the arm. The or each small magnet can be of any shape and can be arranged so as to magnetically connect with a magnetic part of the base when the arm is moved manually to the stowed position. The magnet can be fixedly attached to the arm using a screw thread or some other locking mechanism.

In one embodiment there is provided a base end cap. The base end cap may include magnetic elements, which as defined herein may include magnetically-responsive metal. The base end cap may include a plurality of recesses for locating a cooperating portion of the remote end of the or each arm. This facilitates moving to the stowed position and maintaining the or each arm against the base. A magnet may be provided at the base of each recess. In one embodiment there are four recesses in the base end cap. In one embodiment the base end cap provides a shield wall to protect the or each arm at their distal ends.

The magnetic portions of the base and the arms connect when the arms are folded thereby securing the arms to the base. The securing of the arms through magnetic connection should be strong enough to keep the arms in position even with some jolting of the assembly e.g. when driving, but the connection should not be so strong that is it difficult to magnetically disconnect an arm from the base and pivot it away from the base for use. A magnetic "snap" together and "snap" apart connection is sufficient and can be provided by many commercially available magnets. Once the arms are stowed, a cover or lid can be placed over and/or around the arms to protect them. The lid can be hingedly connected to the base. The lid can be lockable if desired. The cover may be slid into a cooperating recess on the base and held in position there. In use when in the stowed position the recesses which have angled walls for lead-ins, may provide some assistance with retention by inhibiting sliding around off the face of the magnet. Some assistance with retention in the stowed position may be provided by a cover and/or straps associated therewith.

BRIEF DESCRIPTION OF THE DRAWINGS

Embodiments of the invention will now be described with reference to the following drawings, which are intended to be exemplary only so as to improve and understanding of the invention and in which.

The drawings are not shown to scale and are for illustrative purposes only.

DETAILED DESCRIPTION OF PREFERRED EMBODIMENTS

Figure 10:
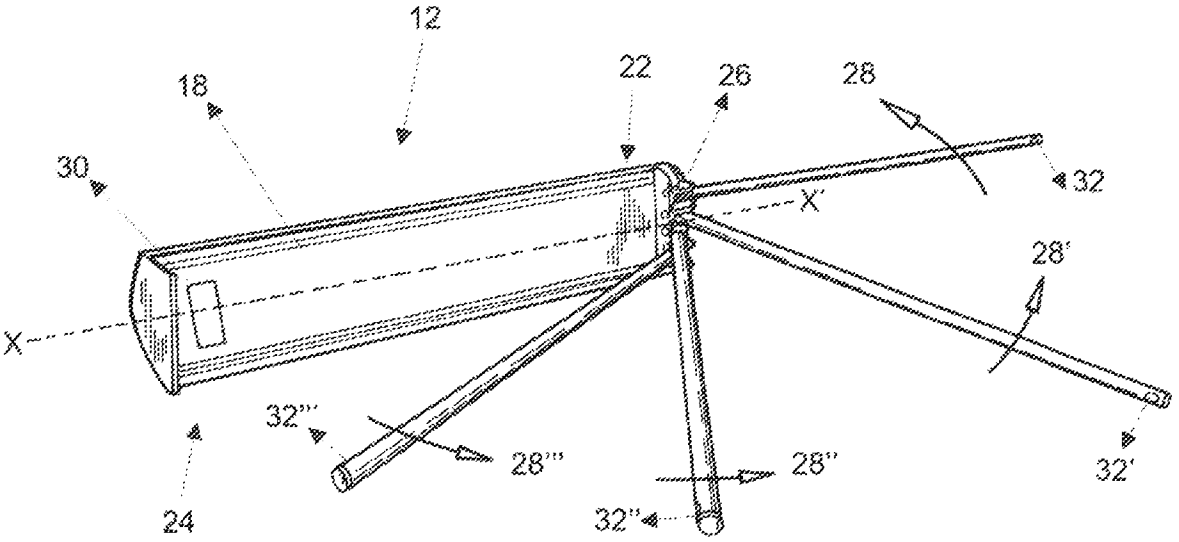
FIG. 10 shows a prototype awning with sheet removed for clarity.

FIG. 10 shows a prototype of an awning assembly 12. The prototype, just like the other embodiment described in this specification, is to be mounted on a vehicle (not shown) that has a roof. Mounted on the roof is a roof rack assembly (not shown) that includes a plurality of supports 16 that secure the roof rack assembly to the vehicle. Enclosing the awning assembly 12 in the stowed position is a cover 13 which attempts to protect the awning assembly when not in use.

FIGS. 1 to 10 show the awning assembly 12 separate from the vehicle for ease of understanding of the details of the invention. Turning first to FIG. 10, the awning assembly 12 includes an elongate base 18 that has a general longitudinal axis marked by line X-X. In this embodiment, the elongate base 18 comprises an aluminium alloy and includes a front face 20. The elongate base 18 has a first end 22 and a second end 24. Fixed towards the first end 22 is a pivot part 26. The second end 24 of the elongate base 18 is rounded in shape so as to be aesthetically pleasing.

Pivotally attached to the elongate base 18 by means of the part 26 is a plurality of arms 28. The four arms 28, 28', 28" and 28'" are pivotally attached to the elongate base 18 by the pivot part 26 for angular movement. The movement allows an expanded position for use, and a stowed position.

The pivot part 26 has a plurality of flanges, each providing an aperture, with the apertures being aligned along an axis. Each mounting has an eyelet that is located is adjacent the flanges so that a pivot pin passing through the apertures and the apertures of the mountings, pivotally attaches an end of each of the arms 28, 28', 28" and 28'" to the pivot part 26 and therefore to the elongate base 18.

In use, associated with the arms 28, 28', 28" and 28'" is a flexible sheet. The sheet is not shown so that the arms can be clearly seen. In some embodiments an edge of the sheet can also be attached to the elongate base 18. The flexible cover provides the cover of the awning.

Figure 1:
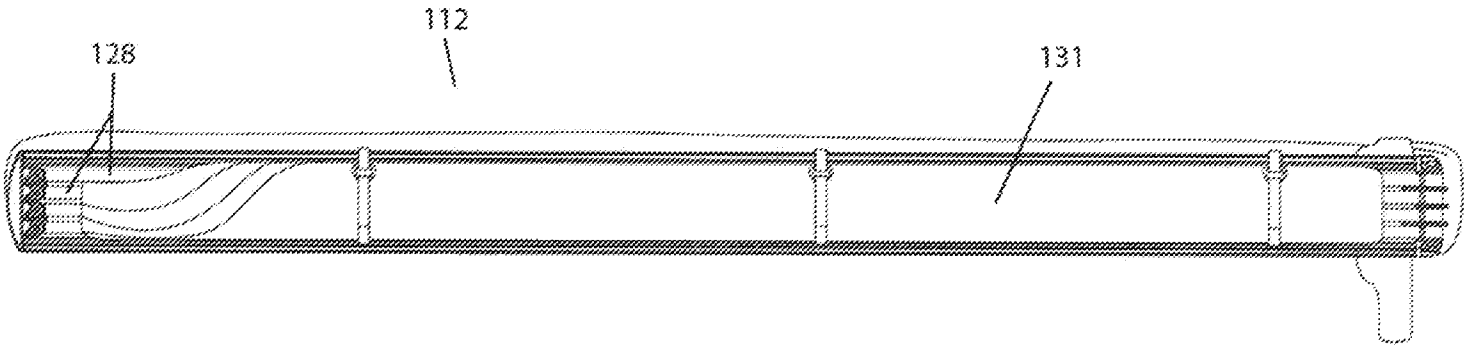
FIG. 1 is a side elevation view of the awning assembly according to a preferred embodiment, as it would look when mounted on a vehicle, with the awning in a stowed position with a cover element folded back for clarity.
Figure 2:
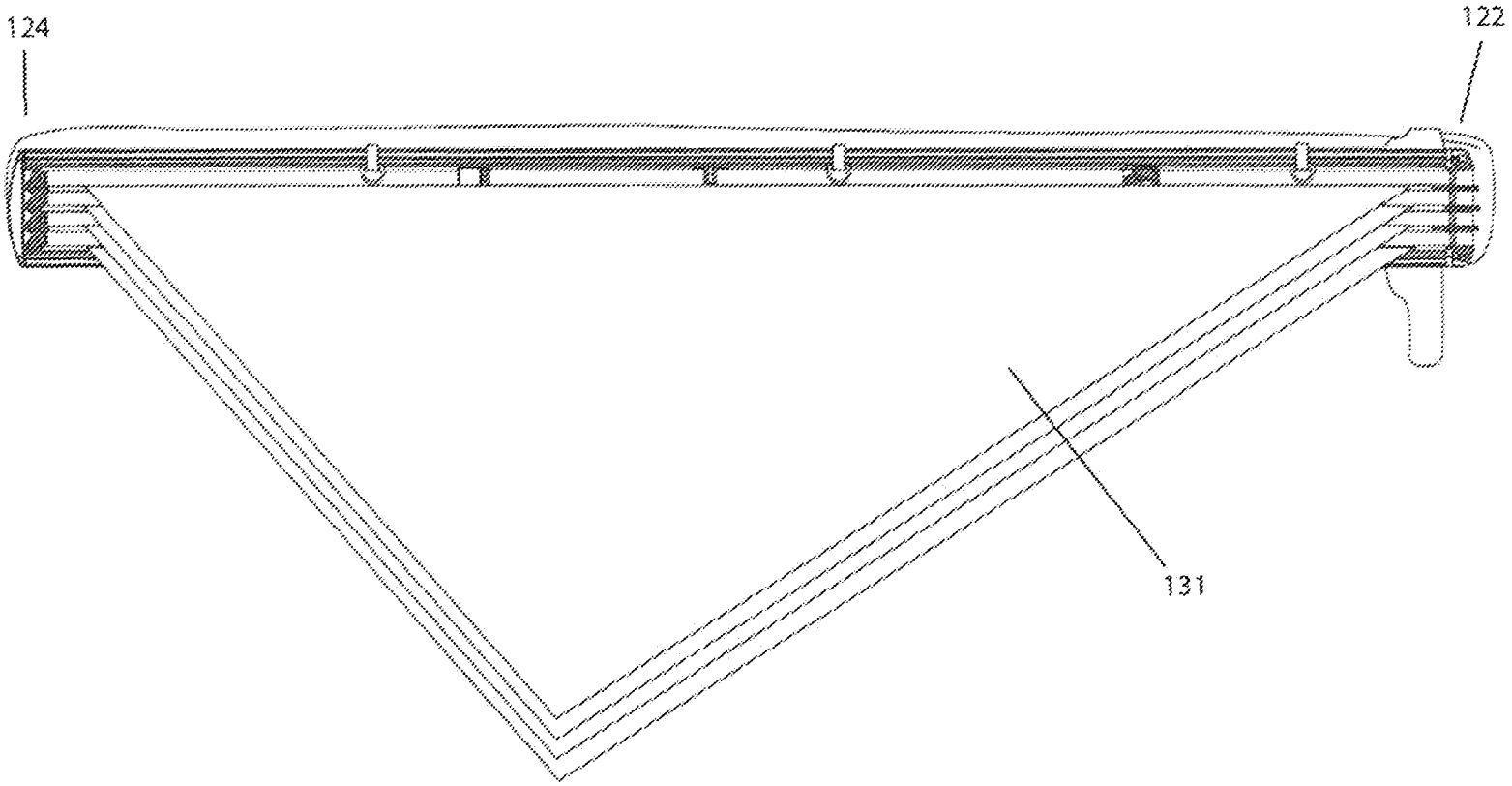
FIG. 2 is a side elevation view of the awning assembly according to a preferred embodiment, shown with a flexible sheet unfolded from around a plurality of arms and still in the stowed position.
Figure 3:
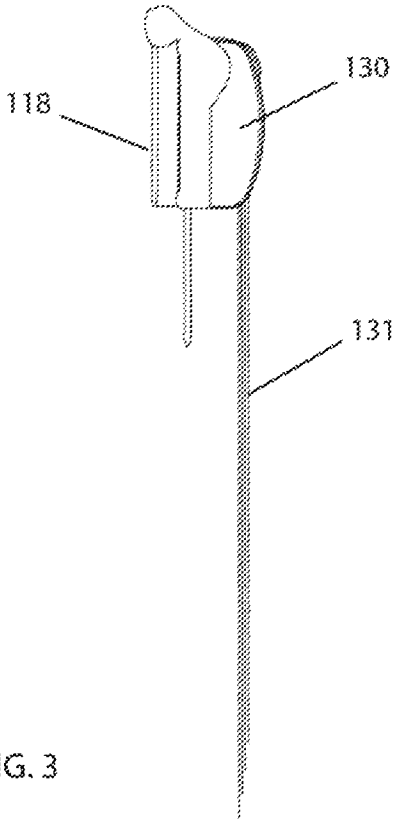
FIG. 3 is a front end view of FIG. 2.
Figure 4:
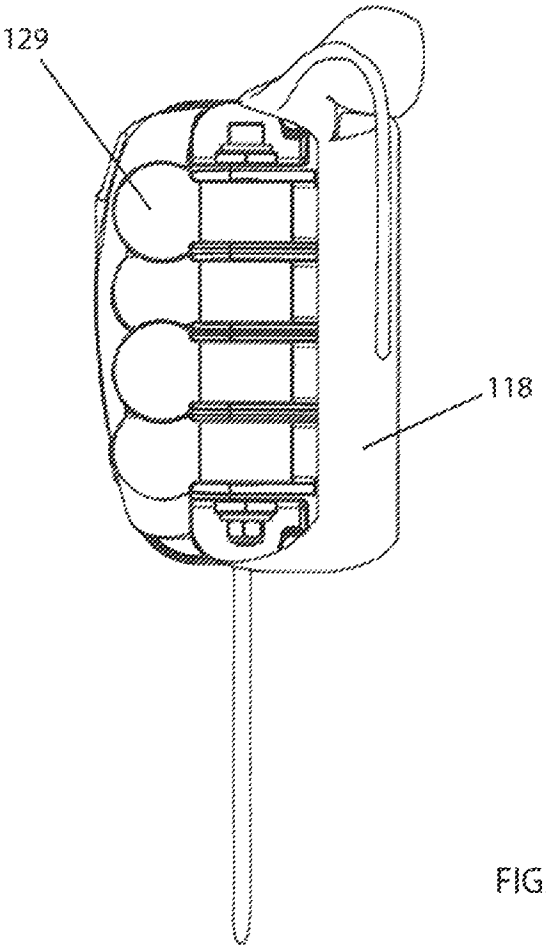
FIG. 4 is a rear end view of FIG. 1.
Figure 5:
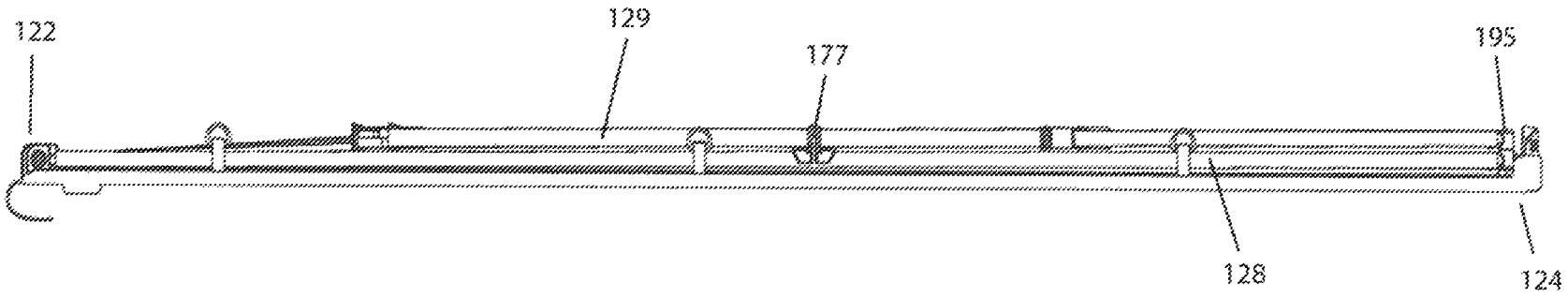
FIG. 5 is a plan view from underneath of the stowed awning shown in FIGS. 2 and 3.
Figure 6:
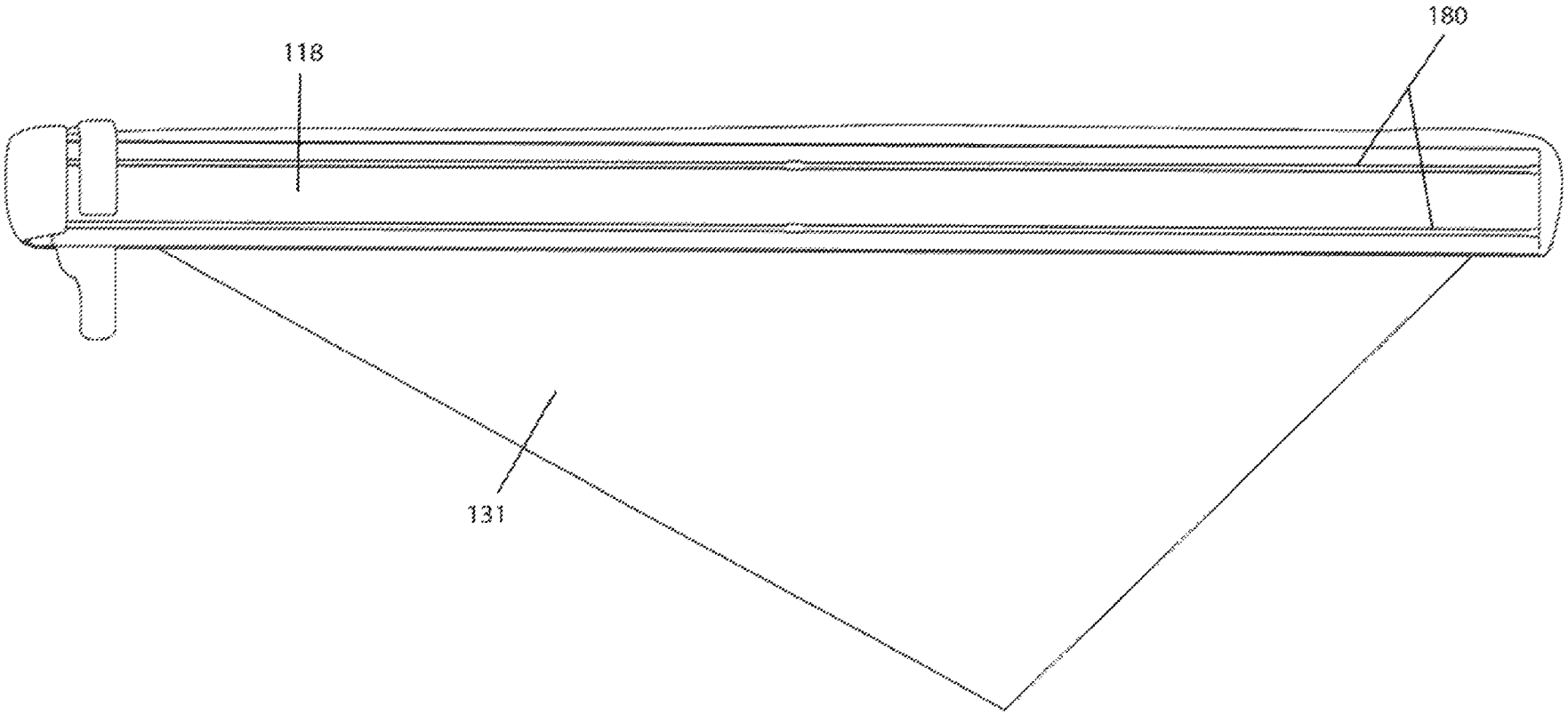
FIG. 6 is a back side elevation view of FIG. 1.
Figure 7:
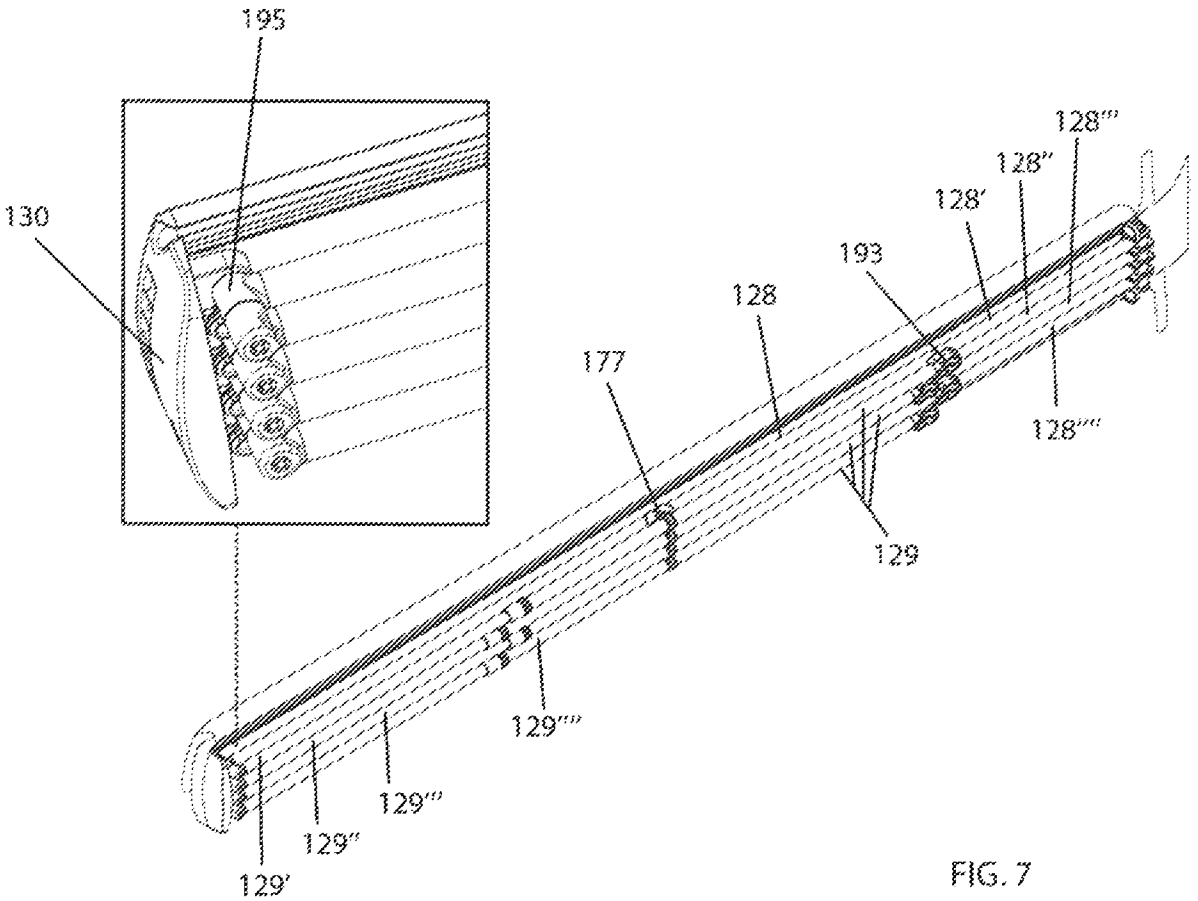
FIG. 7 is an isometric view of the stowed awning of the previous drawings, with a detail view of the front end showing how the arms are arranged when stowed. The awning sheet and cover are not shown for clarity.
Figure 8:
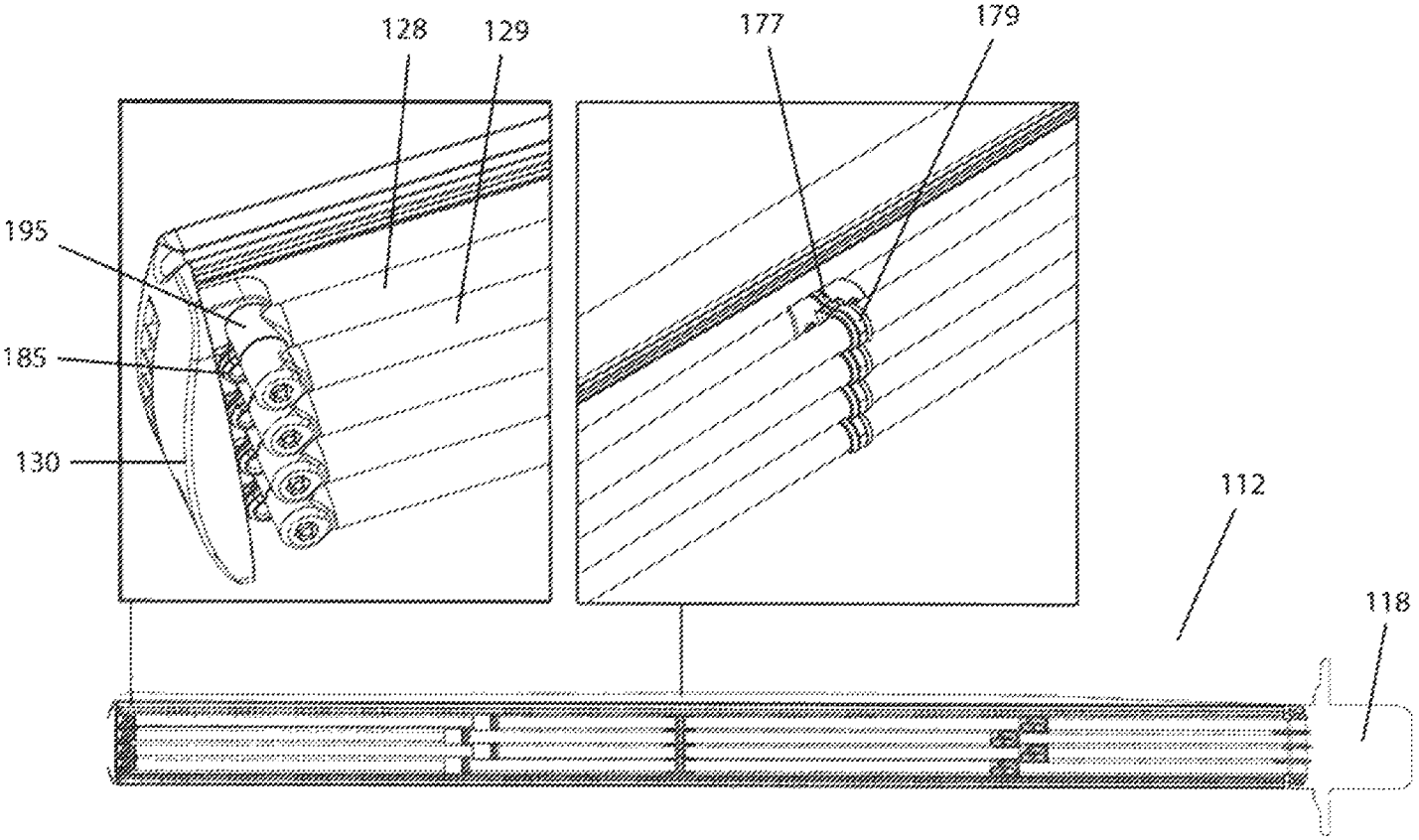
FIG. 8 shows detail views of FIG. 1, the detail of a front end magnet mounting bracket and a clip mounted on a sheet support arm for keeping an arm support portion in a stowed position.
Figure 9:
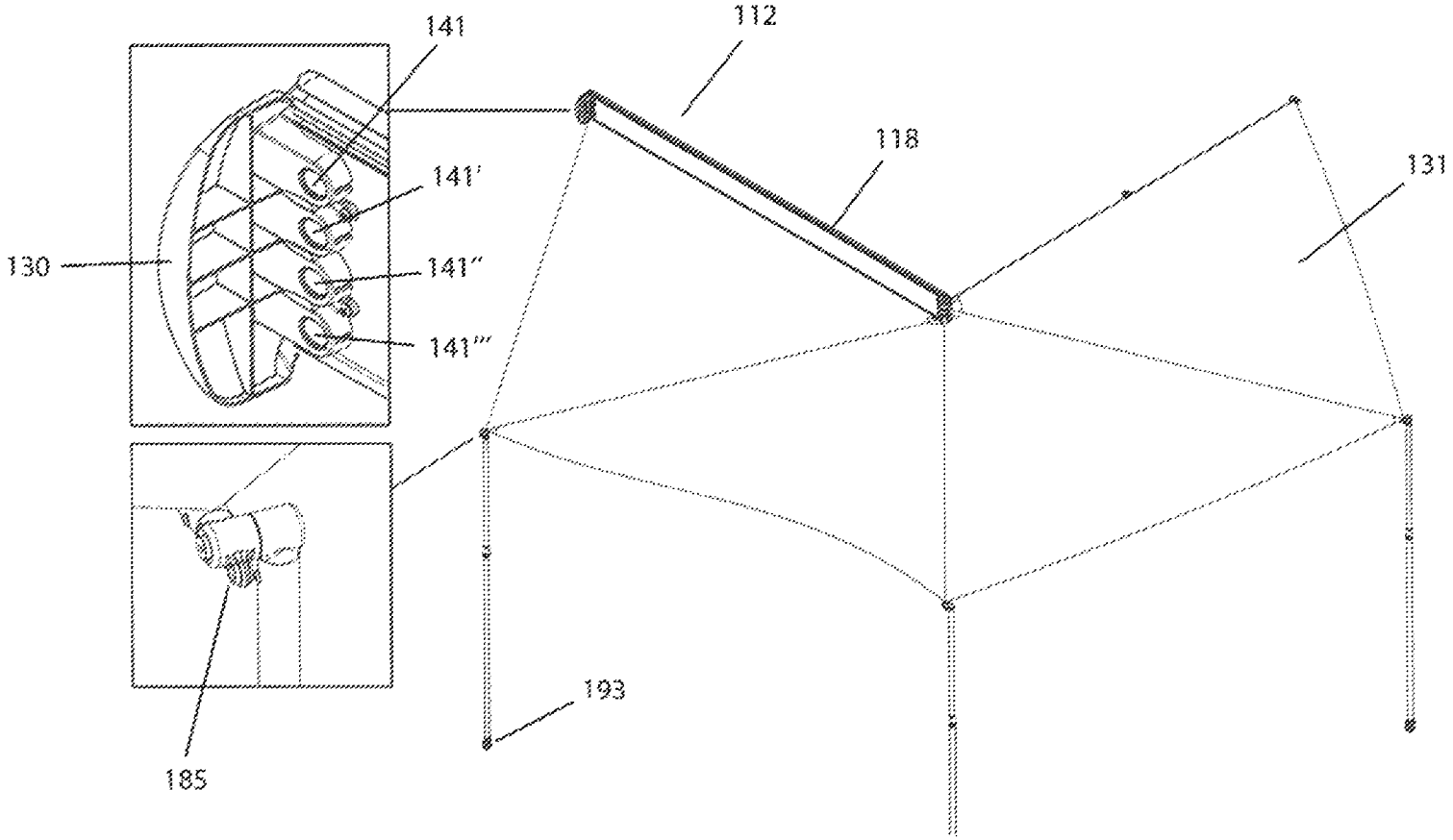
FIG. 9 shows the awning in a deployed position with detailed views of the front end magnet mounting bracket and a tie down disposed on an articulated arm joint.

The arms 28, 28', 28" and 28'" are movable from a folded or stowed configuration in which they are located adjacent the elongate base 18 and extend generally parallel thereto (as seen in FIG. 8) to an expanded configuration as shown in FIG. 9. In the expanded configuration, the cover provided by the flexible sheet 131 provides a sheltered area adjacent the vehicle (not shown).

The elongate base 18 has at the second end thereof a metal plate 30 recessed into the base body. Advantageously, the front face 20 of the base is substantially flat and free from obstruction by the flush mounting of the metal plate in the base body. The metal plate 30 is a magnet.

Each arm 28, 28', 28" and 28'" has attached thereto a small magnet 32, 32', 32", 32'". The magnet is attached to the respective arm by screwing an outer magnet part on the outside of the arm to a respective inner magnet part disposed in the inside of the tube of each arm as shown in FIG. 10.

In the stowed position, the magnets 32, 32', 32", 32'" and metal plate 30 are magnetically connected to one another simply by the action of folding the arms. The magnetic connection secures the arms to the base. A further advantage of the arrangement of the present invention can also be seen in the embodiment of FIG. 10 in that if any arm 28, 28', 28" and 28''' is slightly offset after use, it will still connect and be securable to the base, since there is no predetermined plane or location at which the arm 28, 28', 28" and 28''' must lie on elongate base 18.

A production sample of awning assembly 112 in accordance with a preferred embodiment is shown in FIGS. 1 to 9. In FIGS. 1 to 8 the embodiment is shown in the stowed position, and in FIG. 9 the embodiment is shown in a deployed position. The awning assembly 112 comprises many similar parts to that shown and discussed in relation to the prototype, and like numerals (for example, 12, 112) will denote like parts in the following discussion. The awning assembly 112 comprises an elongate base 118 attachable to the vehicle, the base 118 having a first end 122 and an opposing second end 124, a portion of the base spaced from the first end being magnetic or responsive to magnetic force. There is shown a plurality of arms 128 operatively attached to the first end of the base 118, by means of a hinge 126 having a hinge axis vertically disposed at the first end 122. The arms 128 are pivotable relative to the base between a stowed position and a deployed position. A portion of each arm 128 is magnetic or responsive to magnetic force. The magnets in this embodiment are not attached to the arms but are attached to the base 118, specifically, in the front end magnet mounting bracket 130.

There is provided a flexible sheet 131 associated with the arm assemblies, such that in the deployed position, the arms 128 extend away from the base so that the flexible sheet 131 provides cover to an area beneath the arm assemblies.

In the stowed position (FIGS. 1 to 8), the arms 128 are located adjacent the base so that the magnetic portions of the base and/or the arm assemblies connect thereby holding the arm assemblies against the base.

When in the deployed position (FIG. 9) the vehicle awning 112 provides a convenient cover in the form of shade or shelter to an area adjacent to the vehicle. The cover can be to protect the area from the weather e.g. to provide shade from the sun, and or to provide protection from rain. When the awning 112 is in the stowed position, the arms 128 of the assembly are conveniently held against the base of the assembly so that they do not unintentionally move away from the base thereby potentially causing an unnecessary obstruction and or a danger e.g. the awning is stowed so that it may not wholly or partially expand while the vehicle is in motion.

The awning assembly is advantageously mounted to the vehicle in such a way that it can be used by an operator standing on the ground next to the vehicle.

The awning assembly 112 comprises an elongate base 118. The base 118 can be of any length and width to accommodate the various parts of the awning assembly. The base 118 has a longitudinal axis running in the long direction, and it is approximately the length of the vehicle roof.

The base 118 may be made from any suitable material that is strong and can withstand being attached to and carried on a vehicle at high speeds, up to, say, 150 km/h. The mounting of the base may be by using a bracket arrangement, and the brackets in the embodiment shown are accommodated for attachment at any suitable selected position on the base 118 by tracks or channels 180 mounted on or set into in the base 118.

The base 118 has a first end 122 and an opposing second end 124. A plurality of arms 128 of the awning assembly are attached at the first end 122 of the base 118. The arms 128 may comprise long support struts that, in use, provide a support structure or frame for the awning. In the embodiment there are 4 arms 128', 128", 128''' and 128'''' which support the flexible sheet 131 which is attached to the arms. The flexible sheet 131 is associated with the arms by attaching it to the arms using known techniques. The arms are shown sliding into pockets formed in the flexible sheet 131. Once the arms are in the deployed position, the flexible sheet 131 can provide the cover function of the awning assembly.

The arms 128 are all the same length. The arm supports 129', 129", 129''' and 129'''' are telescopic. The awning itself in the deployed position can fan out around the vehicle at least 180, 200, 270 degrees as described herein.

The arms 128 of the assembly are able to support their own weight, the weight of the arm supports 129 and the weight of the flexible sheet cover 131. The arm supports, to provide additional structural security, can articulate so that in a deployed position they are vertically disposed, and in a stowed position they are horizontally disposed. The articulation is via a joint 195 at a distal end of the arms 128. The arms are tubes of aluminium.

The articulation of each arm 128 and arm support 129 is within one plane only (but as can be seen in the drawings and as described herein, not the same plane). The arms 128 pivot about a vertical axis so as to facilitate fanning around the vehicle, and the arm supports 129 pivot about a joint 195 having a horizontal axis so as to allow the arm supports 129 to drop down into a vertical or support position when deployed. In the stowed position, the arms 128 and 129 are folded to be adjacent to the base, and one above the other, so as to be in a 4×2 arrangement.

The joint 195 includes a tie down point being a loop 185 so as to facilitate increased security of the sheet when in the deployed position. A guy rope (not shown) is tied to the loop 185.

Each arm support 129 has a foot 193 having two through apertures for receiving tent pegs. The through apertures are crossed and diagonally extending downwards for increased security. In one embodiment the foot has a tie down point just like the loop 185 at the top of the arm support 129.

The arm supports are extensible, by telescoping.

The arms are arranged in the stowed position such that they are disposed in a regular array so as to form a convenient and compact shape. It can be seen that the arms adopt a 4×2 array.

The arms 128 include a catch 177 for catching the arm supports 129. The catch 177 is mounted on the arm 128 at an intermediate portion so that the arm supports 129 may be able to be retained against the arm even if the arm support is not in an extended position. The catch is shown to be a flexible clip 179 having arms defining a bight for cooperating with the arm cross-section and receiving it therein. In use, to go from the deployed to the stowed position, the arm support 129 is swung up from the ground and in one movement slips into the bight and is retained there, in a horizontal position, stowed against the arm 128.

A second end portion 124 of the base 118, spaced from the first end 122, is magnetic. The second end of the base is magnetic, because of the presence of magnets in the front end magnet mounting bracket 130, which acts as a front shield. The magnetic portion comprises a series of small magnets (not shown) attached to the magnet mounting bracket 130, each one behind a recess 141, 141', 141", and 141''' for receiving and attracting a magnetically-responsive metal portion in the joint 195. Each magnet can be of any shape and can be arranged so as to magnetically attract and hold the joint 195 when the arm is in the stowed position.

When the arms are folded for storage, a portion of the joint 195 then contacts with the recess and is magnetically held therein.

The recesses in the front end magnet mounting bracket have slight guides or lead-ins to facilitate receiving the joints 195, but are not too great so as to reduce slop and backlash when the joints are in the stowed position against the base 118. This reduces the likelihood of the joints being released from the recesses.

The second end portion includes an arm retainer. The arm retainer includes a plurality of arm receivers, each arm retainer having a recess to receive a portion of a respective arm. The arm retainer is shown to include an integral shield for protecting the arms from wind and other environmental factors. The shield can be of any suitable shape so as to reduce the aerodynamic force on the arms themselves and the awning assembly generally. The shield may also be integral, and flanged in various places as shown, covering the end of the base 118 and so on, so as to reduce air moving between the base 118 and the arms 128 and arm supports 129.

In operation the magnetic portions of the base and the arms connect when the arms are folded thereby securing the arms to the base. The magnetically-responsive portion of each arm is a bolt forming a hinge pivot axis in the joint 195 at the end of the arms 128. The securing of the arms through magnetic connection should be strong enough to keep the arms in position even with some jolting of the assembly e.g. when driving in the stowed position, but the connection should not be so strong that is it difficult to magnetically disconnect an arm from the base and pivot it away from the base for use. A magnetic "snap" together and "snap" apart connection is sufficient and can be provided by many commercially available magnets. The recesses assist with retention by having walls (with slight lead-ins) which reduce the arm ends sliding off the magnets. Once the arms are stowed, a cover or lid can be placed over and/or around the arms to protect them. The lid can be hingedly connected to the base. The lid can be lockable if desired. The cover in the embodiment shown is such that it may be slid into a cooperating recess on the base and held in position there.

In this specification, unless the context clearly indicates otherwise, the term "comprising" has the non-exclusive meaning of the word, in the sense of "Including at least" rather than the exclusive meaning in the sense of "consisting only of". The same applies with corresponding grammatical changes to other forms of the word such as "comprise", "comprises" and so on.

It will be apparent that obvious variations or modifications may be made which are in accordance with the spirit of the invention and which are intended to be part of the invention, and any such obvious variations or modifications are therefore within the scope of the invention.

The invention claimed is:

1. An awning assembly for use with a vehicle, the awning assembly comprising:

an elongate base attachable to the vehicle, the base having a first end and an opposing second end;

a magnetic portion located proximal to the second end of the base;

a plurality of arms pivotably attached at the first end of the base, the plurality of arms pivotable relative to the base between a stowed position and a deployed position, each of the plurality of arms comprising a magnetic arm portion;

a shield protruding perpendicular to the second end of the base, the shield being shaped to shield the plurality of arms from wind when the arms are in the stowed position; and a flexible sheet associated with the arms;

wherein:

at least one of the magnetic portion and the magnetic arm portion comprises at least one magnet, and the other comprises either a magnet of opposing polarity to the at least one magnet, or a magnetically-responsive metal;

in the stowed position, the arms are positioned adjacent the base, such that the magnetic arm portion of each of the plurality of arms is magnetically retained within the magnetic portion, thereby at least partially securing the arms in the stowed position; and in the deployed position, the arms extend away from the base so that the flexible sheet provides cover to an area beneath the arms.

2. The awning assembly of claim 1, wherein the arms are disposed substantially against the elongate base and parallel therewith when in the stowed position, and the arms splay outwardly from the first end when in a deployed position.

3. The awning assembly of claim 1, wherein the arms are arranged on a pivot so that each one is disposed incrementally along a vertical pivot axis.

4. The awning assembly of claim 1 further including an arm retainer disposed at the second end of the base, the arm retainer comprising a plurality of arm receivers, each arm receiver having a recess to receive a portion of a respective arm of the plurality of arms.

5. The awning assembly of claim 4, wherein each recess includes a guide or lead-in portion to facilitate receiving the portion of each respective arm within the recess.

6. The awning assembly of claim 5, wherein the guide or lead-in portion is adapted to reduce slop and backlash of each respective arm when stowed therein.

7. The awning assembly of claim 1, wherein at least one arm includes an arm support pivotally connected thereto by a joint;

the arm support being disposed outboard of its respective arm, relative to the base, when the arm is in the stowed position; and the arm support pivots to extend vertically downwards from the arm when the arm is in the deployed position.

8. The awning assembly of claim 7, wherein the joint comprises a pivot pin; and the pivot pin is at least partially formed of a magnetically-responsive material, thereby forming the magnetic arm portion.

9. The awning assembly of claim 1, wherein the magnetic arm portion of each arm comprises a magnet.

10. The awning assembly of claim 1, wherein the base comprises an outwardly-facing base surface extending between the first and second end, the plurality of arms lying parallel thereto when in the stowed position; and the magnetic portion of the base comprises an array of magnets mounted within the base, and a surface that receives a respective magnetic arm portion when the arms are in the stowed position;

such that the surface of the magnetic portion is flush with the base surface.

11. The awning assembly of claim 1 wherein the shield is curved in a convex manner across an outwardly-facing surface thereof.

12. The awning assembly of claim 1 wherein the shield is integral to the base.

13. The awning assembly of claim 1 further comprising an end cap at the second end of the base; and the shield is formed by the end cap.

* * * * *